US006770827B1

(12) United States Patent
Wong

(10) Patent No.: US 6,770,827 B1
(45) Date of Patent: Aug. 3, 2004

(54) ELECTRICAL ISOLATION OF FLUID-BASED SWITCHES

(75) Inventor: Marvin Glenn Wong, Woodland Park, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/414,129

(22) Filed: Apr. 14, 2003

(51) Int. Cl.[7] ..... H01H 29/06
(52) U.S. Cl. ..... 200/182; 200/193
(58) Field of Search ..... 200/181, 182, 200/185, 188, 190–194, 198, 199, 228, 241, 243, 220–224, 233–235

(56) References Cited

U.S. PATENT DOCUMENTS

| | | | |
|---|---|---|---|
| 2,312,672 | A | 3/1943 | Pollard, Jr. |
| 2,564,081 | A | 8/1951 | Schilling |
| 3,430,020 | A | 2/1969 | Von Tomkewitsch et al. |
| 3,529,268 | A | 9/1970 | Rauterberg |
| 3,600,537 | A | 8/1971 | Twyford |
| 3,639,165 | A | 2/1972 | Rairden, III |
| 3,657,647 | A | 4/1972 | Beusman et al. |
| 4,103,135 | A | 7/1978 | Gomez et al. |
| 4,200,779 | A | 4/1980 | Zakurdaev et al. |
| 4,238,748 | A | 12/1980 | Goullin et al. |
| 4,245,886 | A | 1/1981 | Kolodzey et al. |
| 4,336,570 | A | 6/1982 | Brower |
| 4,419,650 | A | 12/1983 | John |
| 4,434,337 | A | 2/1984 | Becker |
| 4,475,033 | A | 10/1984 | Willemsen et al. |
| 4,505,539 | A | 3/1985 | Auracher et al. |
| 4,582,391 | A | 4/1986 | Legrand |
| 4,628,161 | A | 12/1986 | Thackrey |
| 4,652,710 | A | 3/1987 | Karnowsky et al. |
| 4,657,339 | A | 4/1987 | Fick |

(List continued on next page.)

FOREIGN PATENT DOCUMENTS

| | | |
|---|---|---|
| EP | 0593836 A1 | 4/1994 |
| FR | 2418539 | 9/1979 |
| FR | 2458138 | 12/1980 |
| FR | 2667396 | 4/1992 |
| JP | 62-276838 | 12/1987 |
| JP | 63-294317 | 12/1988 |
| JP | 8-125487 | 5/1996 |
| WO | WO99/46624 | 12/1999 |

OTHER PUBLICATIONS

US2002/0037128 A1, Mar. 28, 2002, Gerardus Johannes Burger, et al.
US2002/0146197 A1, Oct. 10, 2002, Yoon–Joong Yong.
US2002/0150323 A1, Oct. 17, 2002, Naoki Nishida, et al.
US2002/0168133 A1, Nov. 14, 2002, Takeshi Saito.

(List continued on next page.)

*Primary Examiner*—Elvin Enad
*Assistant Examiner*—Lisa Klaus

(57) ABSTRACT

A channel plate is mated to a substrate to define at least a portion of a number of cavities. The channel plate is provided with a switching fluid channel, and a pair of ground channels adjacent the switching fluid channel. A switching fluid is held within a cavity defined by the switching fluid channel, and is movable between at least first and second switch states in response to forces that are applied to the switching fluid. In one embodiment, the ground channels are replaced with ground traces. The ground traces may be formed on or in the substrate or channel plate. Switching circuits incorporating one or more these switches are also disclosed.

23 Claims, 6 Drawing Sheets

U.S. PATENT DOCUMENTS

| | | | | |
|---|---|---|---|---|
| 4,742,263 | A | | 5/1988 | Harnden, Jr. et al. |
| 4,786,130 | A | | 11/1988 | Georgiou et al. |
| 4,797,519 | A | | 1/1989 | Elenbaas |
| 4,804,932 | A | | 2/1989 | Akanuma et al. |
| 4,988,157 | A | | 1/1991 | Jackel et al. |
| 5,278,012 | A | | 1/1994 | Yamanaka et al. |
| 5,415,026 | A | | 5/1995 | Ford |
| 5,502,781 | A | | 3/1996 | Li et al. |
| 5,644,676 | A | | 7/1997 | Blomberg et al. |
| 5,675,310 | A | | 10/1997 | Wojnarowski et al. |
| 5,677,823 | A | | 10/1997 | Smith |
| 5,751,074 | A | | 5/1998 | Prior et al. |
| 5,751,552 | A | | 5/1998 | Scanlan et al. |
| 5,828,799 | A | | 10/1998 | Donald |
| 5,841,686 | A | | 11/1998 | Chu et al. |
| 5,849,623 | A | | 12/1998 | Wojnarowski et al. |
| 5,874,770 | A | | 2/1999 | Saia et al. |
| 5,875,531 | A | | 3/1999 | Nellissen et al. |
| 5,886,407 | A | | 3/1999 | Polese et al. |
| 5,889,325 | A | | 3/1999 | Uchida et al. |
| 5,912,606 | A | | 6/1999 | Nathanson et al. |
| 5,915,050 | A | | 6/1999 | Russell et al. |
| 5,972,737 | A | | 10/1999 | Polese et al. |
| 5,994,750 | A | | 11/1999 | Yagi |
| 6,021,048 | A | | 2/2000 | Smith |
| 6,180,873 | B1 | | 1/2001 | Bitko |
| 6,201,682 | B1 | | 3/2001 | Mooij et al. |
| 6,207,234 | B1 | | 3/2001 | Jiang |
| 6,212,308 | B1 | | 4/2001 | Donald |
| 6,225,133 | B1 | | 5/2001 | Yamamichi et al. |
| 6,278,541 | B1 | | 8/2001 | Baker |
| 6,304,450 | B1 | | 10/2001 | Dibene, II et al. |
| 6,320,994 | B1 | | 11/2001 | Donald et al. |
| 6,323,447 | B1 | * | 11/2001 | Kondoh et al. ..... 200/182 |
| 6,351,579 | B1 | | 2/2002 | Early et al. |
| 6,356,679 | B1 | | 3/2002 | Kapany |
| 6,396,012 | B1 | | 5/2002 | Bloomfield |
| 6,396,371 | B2 | | 5/2002 | Streeter et al. |
| 6,408,112 | B1 | | 6/2002 | Bartels |
| 6,446,317 | B1 | | 9/2002 | Figueroa et al. |
| 6,453,086 | B1 | | 9/2002 | Tarazona |
| 6,470,106 | B2 | | 10/2002 | McClelland et al. |
| 6,487,333 | B2 | | 11/2002 | Fouquet et al. |
| 6,501,354 | B1 | | 12/2002 | Gutierrez et al. |
| 6,512,322 | B1 | * | 1/2003 | Fong et al. ..... 310/328 |
| 6,515,404 | B1 | * | 2/2003 | Wong ..... 310/328 |
| 6,516,504 | B2 | | 2/2003 | Schaper |
| 6,559,420 | B1 | | 5/2003 | Zarev |
| 6,633,213 | B1 | | 10/2003 | Dove |
| 6,646,527 | B1 | * | 11/2003 | Dove et al. ..... 335/47 |

OTHER PUBLICATIONS

US2003/0035611 A1, Feb. 20, 2003, Youchun Shi.

TDB–ACC–NO: NB8406827, "Integral Power Resistors For Aluminum Substrate", IBM Technical Disclosure Bulletin, Jun. 1984, US, vol. 27, Issue No. 1B, p. 827.

Bhedwar, Homi C., et al. "Ceramic Multilayer Package Fabrication." Electronic Materials Handbook, Nov. 1989, PP 460–469, vol. 1 Packaging, Section 4: Packages.

Kim, Joonwon, et al. "A Micromechanical Switch With Electrostatically Driven Liwuid–Metal Droplet." Sensors and Actuators, A: Physical, v 9798, Apr. 1, 2002, 4 pages.

* cited by examiner

ELECTRICAL ISOLATION OF FLUID-BASED SWITCHES

BACKGROUND

Fluid-based switches such as liquid metal micro switches (LIMMS) have proved to be valuable in environments where fast, clean switching is desired. As customers demand smaller and/or faster switches, steps will need to be taken to electrically isolate fluid-based switches from environmental effects.

SUMMARY OF THE INVENTION

One aspect of the invention is embodied in a switch. The switch comprises a channel plate, mated to a substrate to define at least a portion of a number of cavities. The channel plate comprises a switching fluid channel, and a pair of ground channels adjacent the switching fluid channel. A switching fluid is held within a cavity defined by the switching fluid channel, and is movable between at least first and second switch states in response to forces that are applied to the switching fluid.

Another aspect of the Invention is embodied in a switching circuit. The switching circuit comprises a channel plate, mated to a substrate to define at least a portion of a number of cavities. The channel plate comprises first and second switching fluid channels, and a ground channel located adjacent, and substantially in between, the first and second switching fluid channels. A first switching fluid is held within a cavity defined by the first switching fluid channel, and is movable between at least first and second switch states in response to forces that are applied to the first switching fluid. A second switching fluid is held within a cavity defined by the second switching fluid channel, and is movable between at least first and second switch states in response to forces that are applied to the second switching fluid.

Yet another aspect of the invention is embodied In a switch comprising a substrate and a channel plate. The channel plate comprises a switching fluid channel, and is mated to the substrate to define at least a portion of a number of cavities. A pair of ground traces are located adjacent the switching fluid channel. A switching fluid is held within a cavity defined by the switching fluid channel, and is movable between at least first and second switch states in response to forces that are applied to the switching fluid.

Other embodiments of the invention are also disclosed.

BRIEF DESCRIPTION OF THE DRAWINGS

Illustrative embodiments of the invention are illustrated in the drawings, in which.

DETAILED DESCRIPTION OF THE INVENTION

Figure 1:
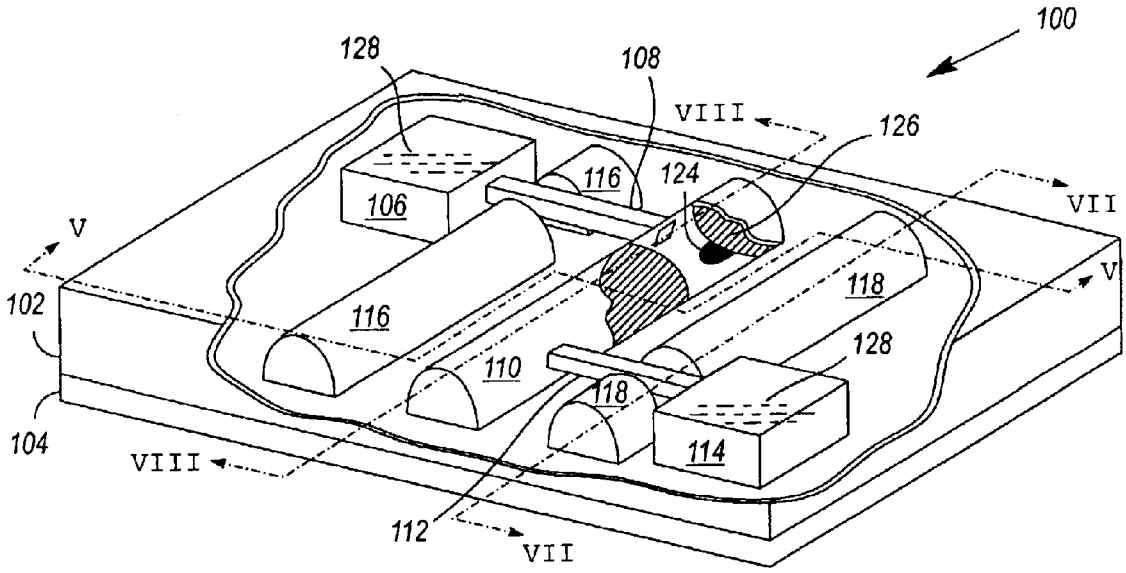
FIG. 1 illustrates a first exemplary embodiment of a switch.

FIG. 1 illustrates a first exemplary embodiment of a switch 100. The switch 100 comprises a channel plate 102 and a substrate 104. As revealed by the broken away portion of channel plate 102 in FIG. 1, the channel plate 102 may define portions of one or more of a number of cavities 106, 108, 110, 112, 114, 116, 118. The remaining portions of these cavities 106–118, if any, may be defined by the substrate 104, to which the channel plate 102 is mated and sealed.

Exposed within one or more of the cavities 106–118 are a plurality of electrodes 120, 122, 124. Only one of these electrodes 124 can be seen in FIG. 1 (through the broken away wall of cavity 110). However, all of the electrodes 120–124 can be seen in the plan view of the substrate 104 illustrated in FIG. 2. A switching fluid 126 (e.g., a conductive liquid metal such as mercury) held within one or more cavities of the switch 100 (e.g., cavity 110) serves to open and close at least a pair of the plurality of electrodes 120–124 in response to forces that are applied to the switching fluid 126. An actuating fluid 128 (e.g., an inert gas or liquid) held within one or more cavities of the switch 100 (e.g., cavities 106, 108, 112 and 114) serves to apply the forces to the switching fluid 126.

In one embodiment of the switch 100, the forces applied to the switching fluid 126 result from pressure changes in the actuating fluid 128. The pressure changes in the actuating fluid 128 impart pressure changes to the switching fluid 126, and thereby cause the switching fluid 126 to change form, move, part, etc. In FIG. 1, the pressure of the actuating fluid 128 held in cavities 106, 108 applies a force to part the switching fluid 126 as illustrated. In this state, electrodes 120 and 122 are coupled to one another. If the pressure of the actuating fluid 128 held in cavities 106 and 108 is relieved, and the pressure of the actuating fluid 128 held in cavities 112 and 114 is increased, the switching fluid 126 can be forced to part and merge so that electrodes 120 and 122 are decoupled and electrodes 122 and 124 are coupled.

Figure 2:
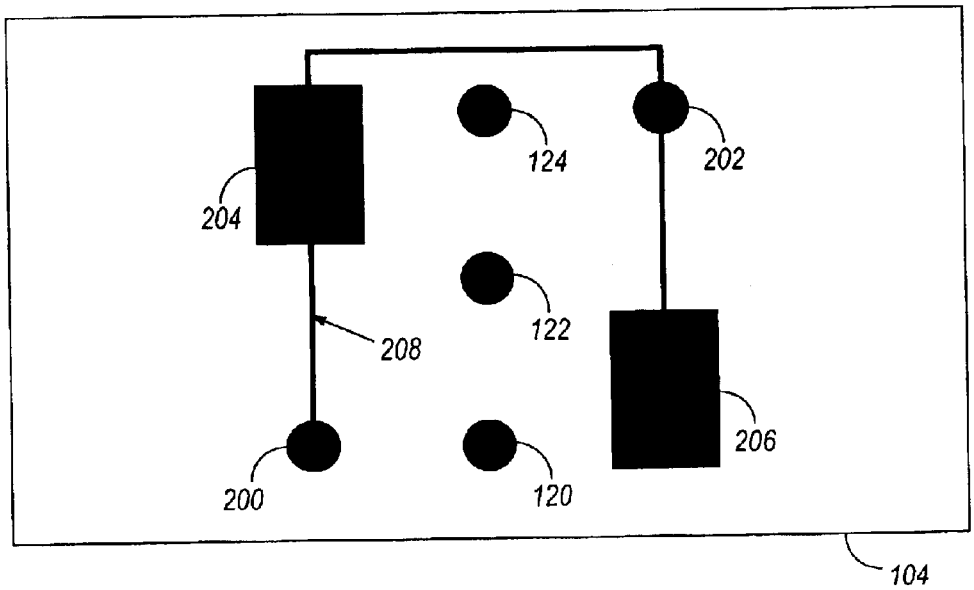
FIG. 2 illustrates a plan view of the substrate of the switch shown in FIG. 1.

Although FIGS. 1 & 2 illustrate three electrodes 120–124, two pairs of which are alternately coupled, a switch could alternately comprise more or fewer electrodes.

By way of example, pressure changes in the actuating fluid 128 may be achieved by means of heating the actuating fluid 128, or by means of piezoelectric pumping. The former is described in U.S. Pat. No. 6,323,447 of Kondoh et al. entitled "Electrical Contact Breaker Switch, Integrated Electrical Contact Breaker Switch, and Electrical Contact Switching Method". The latter is described in U.S. patent application Ser. No. 10/137,691 of Marvin Glenn Wong filed May 2, 2002 and entitled "A Piezoelectrically Actuated Liquid Metal Switch".

Although the above referenced patent and patent application disclose the movement of a switching fluid by means of dual push/pull actuating fluid cavities, a single push/pull actuating fluid cavity might suffice if significant enough push/pull pressure changes could be imparted to a switching fluid from such a cavity.

Figure 3:
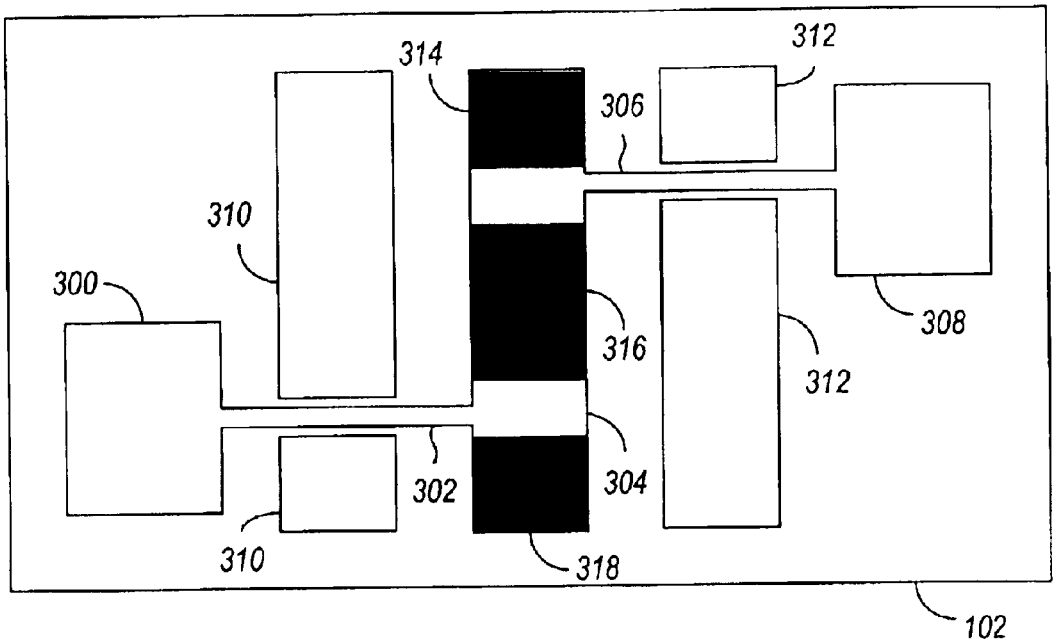
FIG. 3 illustrates a first plan view of the channel plate of the switch shown in FIG. 1.
Figure 4:
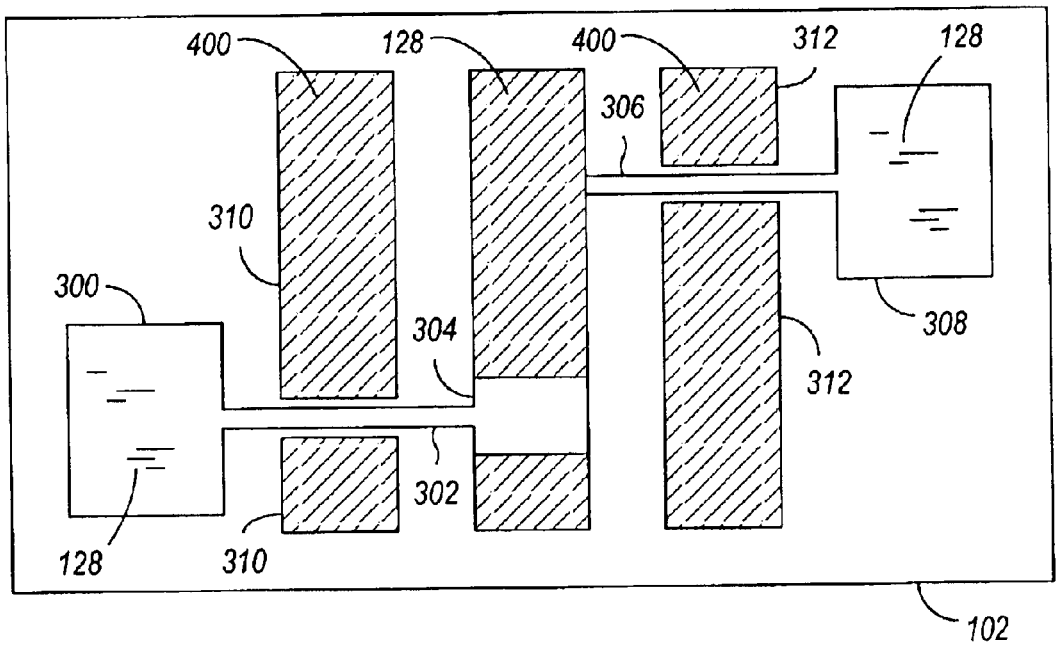
FIG. 4 illustrates a second plan view of the channel plate of the switch shown in FIG. 1.

The channel plate 102 of the switch 100 may have a plurality of channels 300–312 formed therein, as shown in the plan views of the channel plate 102 illustrated in FIGS. 3 & 4. FIG. 3 illustrates the channel plate 102 prior to its channels being filled with fluid, and FIG. 4 illustrates the channel plate subsequent to its channels being filled with fluid. Depending on the composition of the channel plate 102, as well as the channel tolerances desired, channels can be machined, injection molded, press molded, slump molded, etched, laser cut, ultrasonically milled, laminated, stamped or otherwise formed in the channel plate 102.

In one embodiment of the switch 100, the first channel 304 in the channel plate 102 defines at least a portion of the one or more cavities 110 that hold the switching fluid 126. Byway of example, this switching fluid channel 304 may have a width of about 200 microns, a length of about 2600 microns, and a depth of about 200 microns.

A second channel or channels 300, 308 may be formed in the channel plate 102 so as to define at least a portion of the one or more cavities 106, 114 that hold the actuating fluid 126. By way of example, these actuating fluid channels 300, 308 may each have a width of about 350 microns, a length of about 1400 microns, and a depth of about 300 microns.

A third channel or channels 302, 306 may be formed in the channel plate 102 so as to define at least a portion of one or more cavities that connect the cavities 106, 110, 114 holding the switching and actuating fluids 126, 128. By way of example, the channels 302, 306 that connect the actuating fluid channels 106, 114 to the switching fluid channel 110 may each have a width of about 100 microns, a length of about 600 microns, and a depth of about 130 microns.

The channel plate 102 may be mated and sealed to the substrate 104 by means of an adhesive or gasket, for example. One suitable adhesive is Cytop™ (manufactured by Asahi Glass Co., Ltd. of Tokyo, Japan). Cytop™ comes with two different adhesion promoter packages, depending on the application. When a channel plate 102 has an inorganic composition, Cytop™'s inorganic adhesion promoters should be used. Similarly, when a channel plate 102 has an organic composition, Cytop™'s organic adhesion promoters should be used.

Optionally, portions of the channel plate 102 may be metallized (e.g., via sputtering or evaporating through a shadow mask, or via etching through a photoresist) for the purpose of creating "seal belts" 314, 316, 318. The creation of seal belts 314–318 within a switching fluid channel 304 provides additional surface areas to which a switching fluid 126 may wet. This not only helps in latching the various states that a switching fluid 126 can assume, but also helps to create a sealed chamber from which the switching fluid 126 cannot escape, and within which the switching fluid 126 may be more easily pumped (i.e., during switch state changes).

Additional details concerning the construction and operation of a switch such as that which is illustrated in FIGS. 1–4 may be found in the afore-mentioned patent of Kondoh et al. and patent application of Marvin Glenn Wong.

An element of the switch 100 that has yet to be discussed is the existence and use of ground channels 310, 312. As shown in FIG. 3, a ground channel 310, 312 may be formed on either side of a switching fluid channel 304. Although the ground channels 310, 312 may take various forms, and may be located at varying distances from the switching fluid channel 304, the ground channels 310, 312 are preferably formed on either side of the switching fluid channel 304, adjacent and in close proximity to the switching fluid channel 304. In this manner, they provide maximum electrical isolation for the switching fluid 126 (e.g., isolation from nearby circuit activity, stray radio-frequency (RF) signals, microwave signals, and other electrical effects that the fluid 126 in the switching channel 304 may be subjected to in a particular operating environment). The resultant switch may be characterized as a planar coaxial switch.

Given the channel layout of the switch 100 illustrated in FIGS. 1–4, each of the ground channels 310, 312 is bifurcated by one of the channels 302, 306 that connects an actuating fluid channel 300, 308 to the switching fluid channel 304. In this manner, the ground channels 310, 312 provide more electrical isolation for the switching fluid 128 than if they were located on opposite sides of the actuating fluid channels 300, 308. Alternately (not shown), the two parts of each ground channel 310, 312 could be fluidically coupled above or below the connecting channels 302, 306.

In one embodiment of the switch 100, a liquid metal 400 is held within the cavities 116, 118 defined by the pair of ground channels 310, 312. The fluids 126, 400 held in the switching fluid and ground channels 304, 310, 312 may have the same or different composition.

Figure 5:
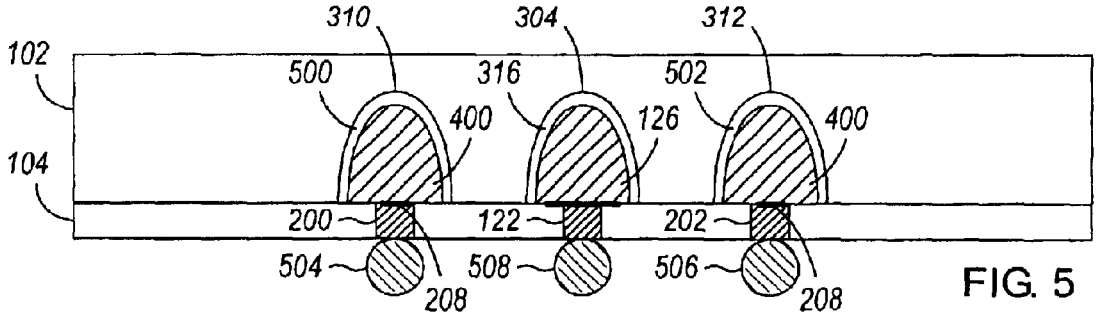
FIG. 5 illustrates a cross-section of the switching fluid and ground channels of the switch shown in FIG. 1.

As shown in FIG. 5, each of the ground channels 310, 312 may be lined with a wettable metal 500, 502. In this manner, the liquid metal 400 that is deposited in each ground channel 310, 312 will wet to the channel's metal lining 500, 502 to form a single grounded element (rather than forming an ungrounded, partially grounded, or intermittently grounded slug within the ground channel).

The substrate 104 to which the channel plate 102 is mated may comprise one or more conductive traces 208 (FIG. 2) that couple the ground channels 310, 312 to each other, as well as to an external ground (that is, a ground that is external to the switch 100). The conductive traces 208 may comprise wettable contact portions and/or conductive vias 200, 202, 204, 206. In this manner, the liquid metal 400 residing in each ground channel 310, 312 may serve as the means that electrically couples the one or more ground traces 208 on the substrate 104 to the wettable metal 500, 502 lining the ground channels 310, 312. The conductive trace 208 and vias 200–206 (FIG. 2) may be coupled to one or more solder balls 504, 506, 700 or other external contacts. See, for example, FIGS. 5 & 7, which show vias 200, 202 and 206 coupled to solder balls 504, 506 and 700. In a similar fashion, each of the electrodes 120–124 may also be coupled to an external solder ball 508, 800, 802 or the like (see FIGS. 5 & 8).

Figure 6:
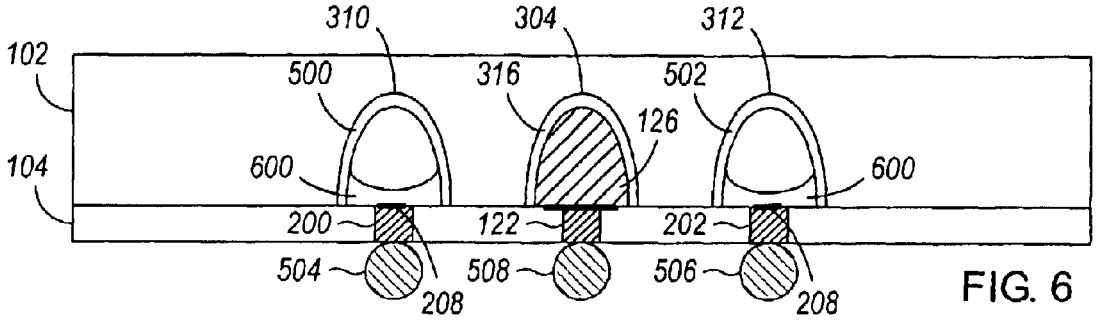
FIG. 6 illustrates a first alternative embodiment of the switch shown in FIG. 1 (via the same cross-section shown in FIG. 5)

In lieu of, or in addition to, the liquid metal 400 that fills the ground channels 310, 312, solder 600 or a conductive adhesive may be used to electrically couple the one or more conductive traces 208 on the substrate 104 to the wettable metal 500, 502 lining the ground channels 310, 312 (see FIG. 6).

Figure 7:
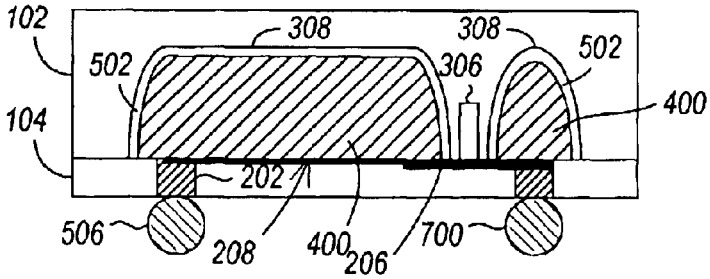
FIG. 7 illustrates a cross-section of one of the ground channels of the switch shown in FIG. 1.

FIG. 7 is a cross-section of FIG. 1 illustrating how the portions of each bifurcated ground channel 310, 312 may be coupled to one another via wettable pads (e.g., pad 206) of the conductive trace 208 on the substrate 104.

Figure 8:
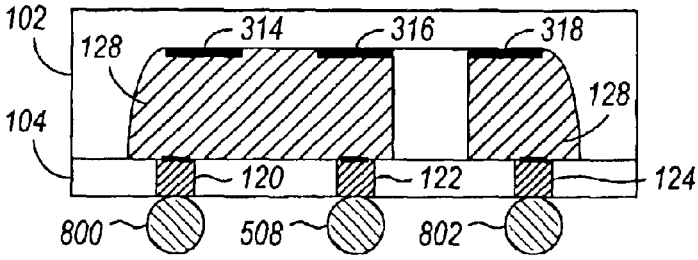
FIG. 8 illustrates a cross-section of the switching fluid channel of the switch shown in FIG. 1.

FIG. 8 is a cross-section of FIG. 1 illustrating the components of the switching fluid cavity 110 in greater detail.

Figure 9:
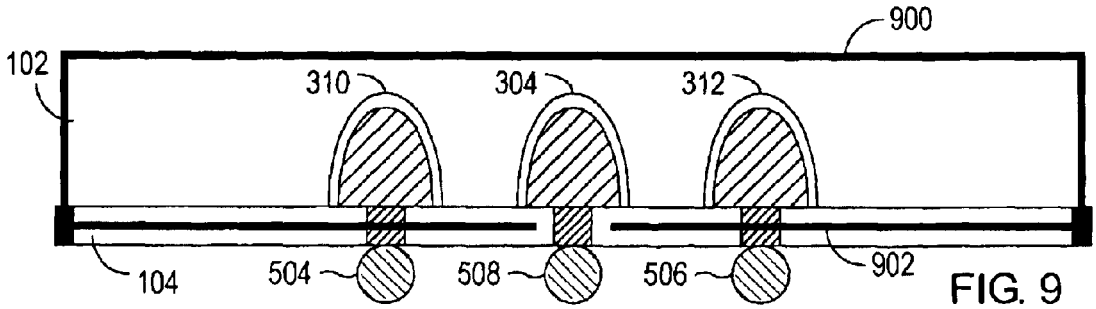
FIG. 9 illustrates a second alternative embodiment of the switch shown in FIG. 1 (via the same cross-section shown in FIG. 5)

As shown in FIG. 9, the switch may further comprise a first ground plane 900 running above the channels 304, 310,

312, and a second ground plane 902 running below the channels. In the embodiment shown, the first and second ground planes 900, 902 are electrically coupled to each other, and to the ground channels 310, 312 (e.g., via contact portions 200, 202 of conductive trace 208). The first ground plane 900 may be bonded to a surface of the channel plate 102 that is opposite the surface in which the channels 304, 310, 312 are formed. The second ground plane 902 may be a layer of the substrate 104 and, in one embodiment, is an interior layer of the substrate 104. The switch illustrated in FIG. 9 may be characterized as a "leaky" full coaxial switch.

Figure 10:
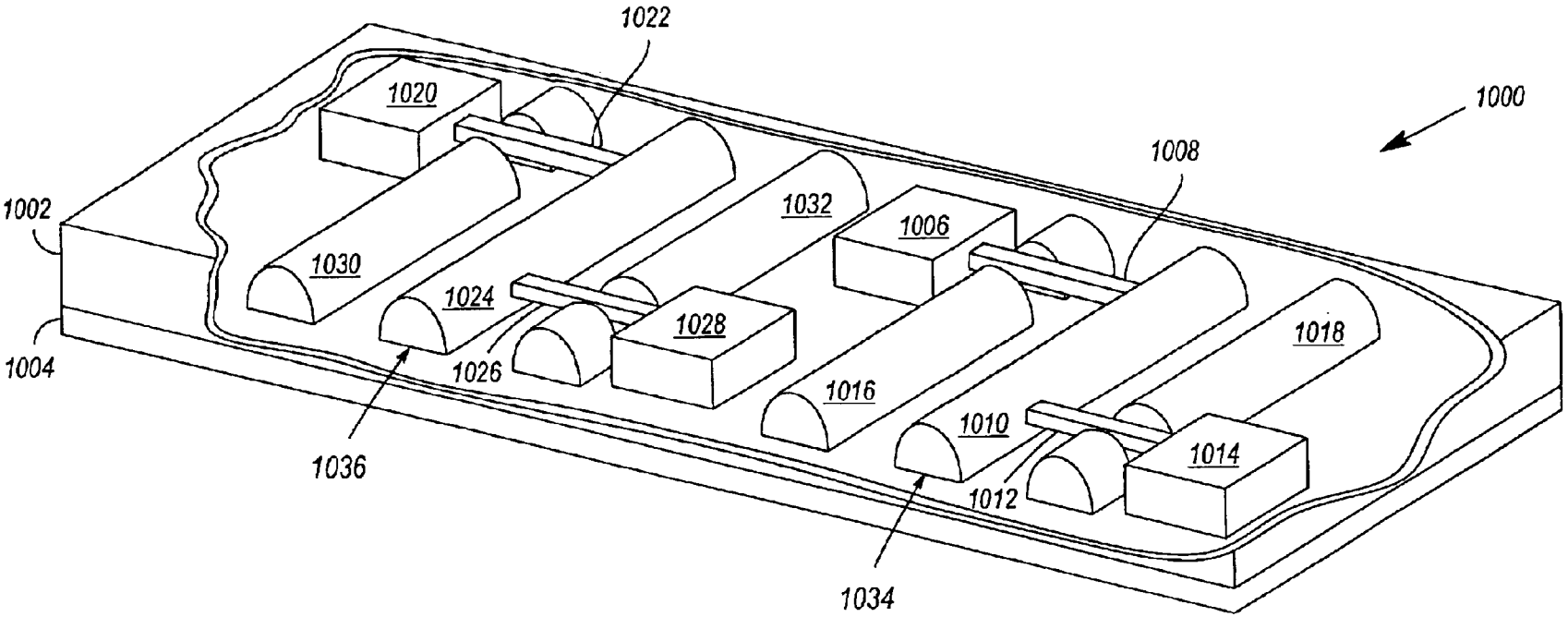
FIG. 10 illustrates a first exemplary switching circuit.

FIG. 10 illustrates a switching circuit 1000 comprising a plurality of electrically isolated switches. Similarly to the switch 100, the switching circuit 1000 comprises a channel plate 1002 that is mated to a substrate 1004 to define at least a portion of a number of cavities. The channel plate 1002 comprises first and second switching fluid channels 1010, 1024 corresponding to first and second switches 1034, 1036. Adjacent and on either side of each switching fluid channel 1010, 1024 is a ground channel 1016, 1018, 1030, 1032. Two of the ground channels 1016, 1032 are located adjacent, and substantially in between, the first and second switching fluid channels 1010, 1024. Each of the remaining two ground channels 1018, 1030 is located adjacent a respective one of the switching fluid channels 1010, 1024 (but not in between the first and second switching fluid channels). Although the outermost ground channels 1018, 1030 would not be necessary to electrically isolate the switches 1034, 1036 from each other, the outermost ground channels 1018, 1030 help to electrically isolate the switches 1034, 1036 from other environmental effects.

The remaining components 1006,1008, 1012,1014, 1020, 1022, 1026, 1028 of the switch 1000 may be configured similarly to their corresponding components (106, 108, 112, 114) in the switch 100. Although not shown, the switching circuit 1000 may further comprise a first ground plane running above its channels, and a second ground plane running below its channels, similarly to the ground planes shown in FIG. 9.

Figure 11:
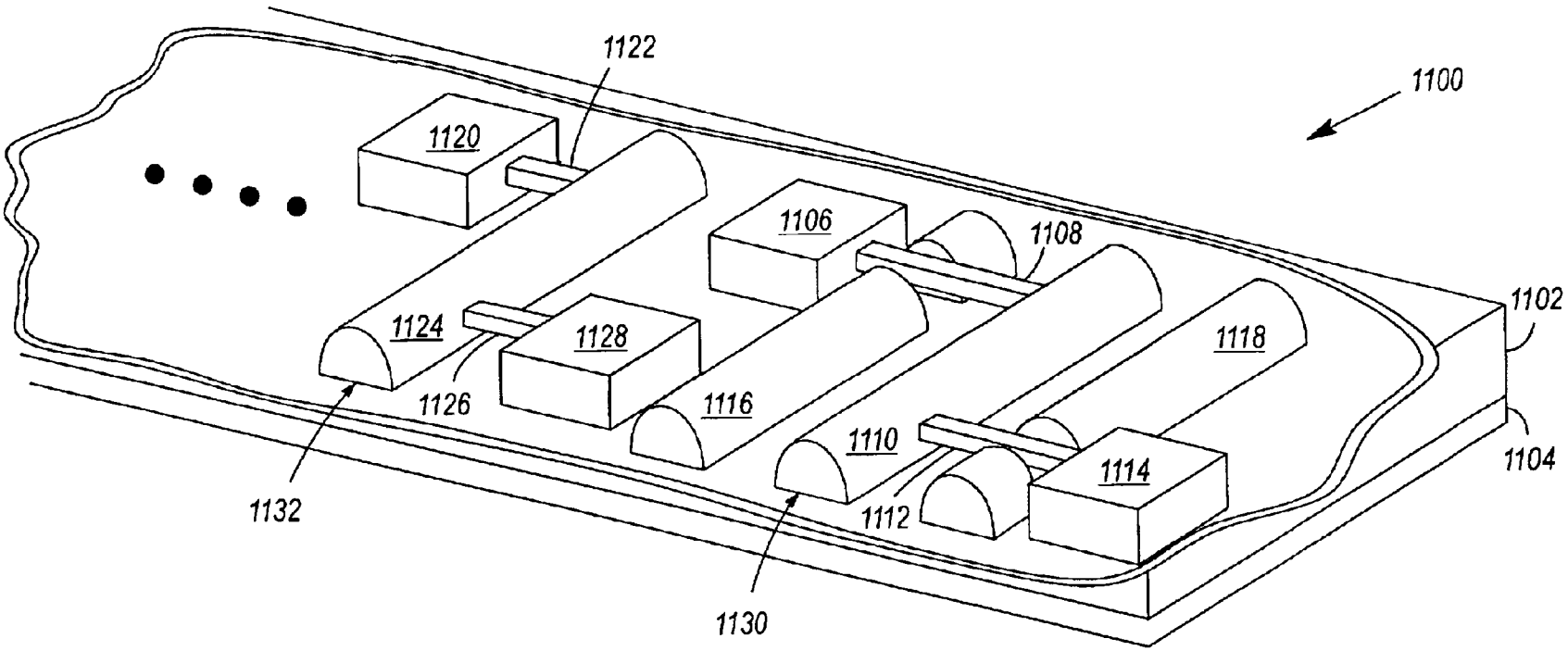
FIG. 11 illustrates a second exemplary switching circuit.

FIG. 11 illustrates an alternate embodiment of a switching circuit 1100. The switching circuit 1100 again comprises components 1102–1128 that function similarly to corresponding components (102–114) in switch 100. In contrast to the switching circuit 1000, the switching circuit 1100 has only ground channel 1116 between adjacent switches 1130, 1132. The switching circuit 1100 therefore provides a denser concentration of switches 1130, 1132 at the risk of somewhat less electrical isolation from environmental effects. As suggested by the ellipses in FIG. 11, a switching circuit may comprise more than two switches 1130, 1132. The same applies to the switching circuit 1000.

Although not shown, the switching circuit 1100 may further comprise a first ground plane running above its channels, and a second ground plane running below its channels, similarly to the ground planes shown in FIG. 9.

Figure 12:
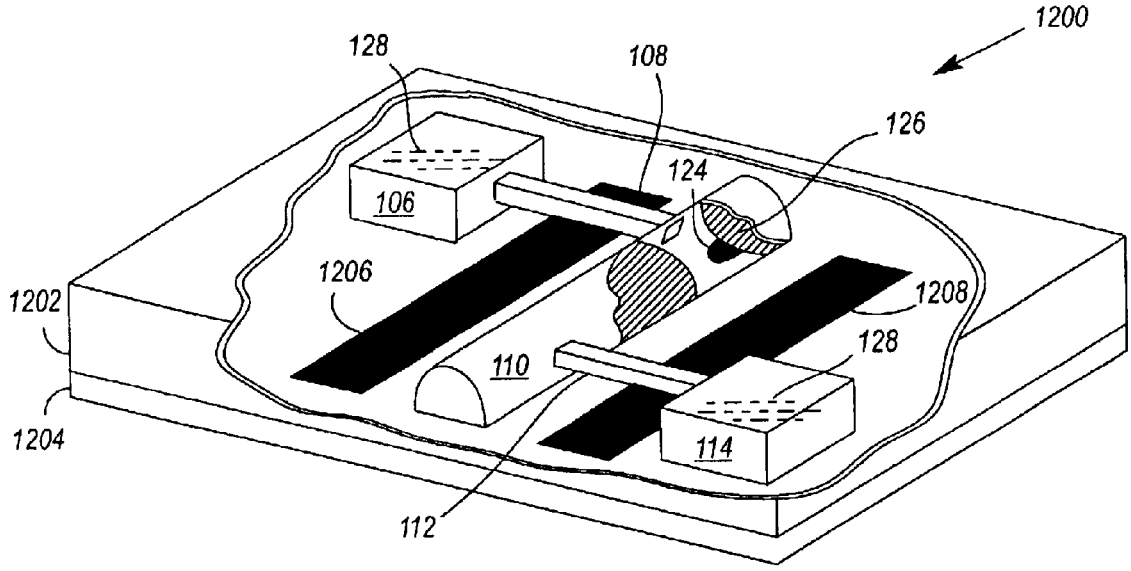
FIG. 12 illustrates a second exemplary embodiment of a switch.
Figure 13:
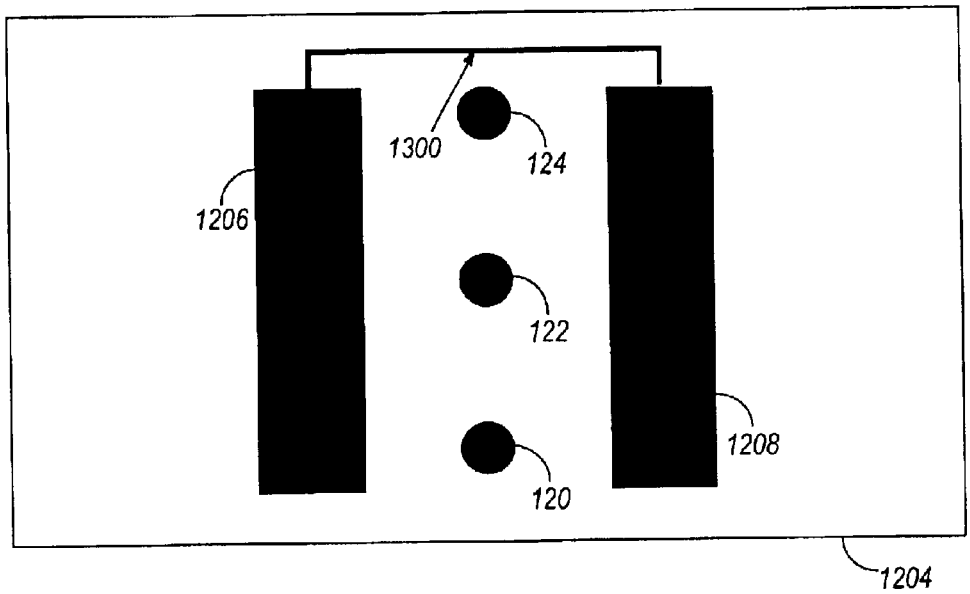
FIG. 13 illustrates a plan view of the substrate of the switch shown in FIG. 1.

Although FIGS. 1–11 disclose switches 100 and switching circuits 1000, 1100 that incorporate ground channels, these ground channels could alternately be replaced with ground traces. FIGS. 12 & 13 therefore illustrate a switch 1200 that is functionally similar to the switch 100 illustrated in FIG. 1, yet with a slightly modified channel plate 1202 and substrate 1204. In contrast to the channel plate 102, the channel plate 1202 does not comprise ground channels. Rather, the substrate 1204 comprises a pair of ground traces 1206, 1208. The ground traces are positioned adjacent the switching fluid channel. As shown in FIG. 13, the pair of ground traces 1206, 1208 may be deposited on the substrate 1204 and coupled via a trace 1300. However, in other embodiments, the pair of ground traces 1206, 1208 may be formed in an interior layer of the substrate 1204, or may be deposited on the channel plate 1202.

Although not shown, the switch 1200 may further comprise a first ground plane running above its channels, and a second ground plane running below its channels, similarly to the ground planes shown in FIG. 9.

The use of ground channels and ground traces is not limited to the switches 100, 1000, 1100, 1200 disclosed in FIGS. 1, 10, 11 & 12 and may be undertaken with other forms of switches that comprise, for example, 1) a channel plate defining at least a portion of a number of cavities, and 2) a switching fluid, held within one or more of the cavities, that is movable between at least first and second switch states in response to forces that are applied to the switching fluid. The patent of Kondoh, et al. and patent application of Marvin Glenn Wong that were previously incorporated by reference disclose liquid metal micro switches (LIMMS) that meet this description.

While illustrative and presently preferred embodiments of the invention have been described in detail herein, it is to be understood that the inventive concepts may be otherwise variously embodied and employed, and that the appended claims are intended to be construed to include such variations, except as limited by the prior art.

What is claimed is:

1. A switch, comprising:

a) a substrate;

b) a channel plate, mated to the substrate to define at least a portion of a number of cavities, and comprising:

i) a switching fluid channel; and ii) a pair of ground channels adjacent the switching fluid channel; and c) a switching fluid, held within a cavity defined by the switching fluid channel, and movable between at least first and second switch states in response to forces that are applied to the switching fluid.

2. The switch of claim 1, wherein each of the ground channels is lined with a wettable metal.

3. The switch of claim 2, further comprising one or more conductive traces on the substrate that are coupled to the wettable metal lining the ground channels.

4. The switch of claim 3, further comprising solder, wherein the solder couples the one or more conductive traces on the substrate to the wettable metal lining the ground channels.

5. The switch of claim 3, further comprising conductive adhesive, wherein the conductive adhesive couples the one or more conductive traces on the substrate to the wettable metal lining the ground channels.

6. The switch of claim 3, further comprising a liquid metal, wherein the liquid metal couples the one or more conductive traces on the substrate to the wettable metal lining the ground channels.

7. The switch of claim 1, further comprising a liquid metal, held within cavities defined by the pair of ground channels.

8. The switch of claim 7, wherein the switching fluid and liquid metal have the same composition.

9. The switch of claim 1, further comprising a first ground plane running above said channels, and a second ground plane running below said channels.

10. The switch of claim 9, wherein the first ground plane is bonded to a surface of the channel plate that is opposite a surface in which said channels are formed.

11. The switch of claim 9, wherein the second ground plane is a layer of the substrate.

12. The switch of claim 11, wherein the second ground plane is an interior layer of the substrate.

13. The switch of claim 9, wherein the first and second ground planes are electrically coupled to each other and to the ground channels.

14. The switch of claim 1, further comprising a conductive trace on the substrate, wherein:

a) the channel plate further comprises an actuating fluid channel, coupled to the switching fluid channel by a channel that bifurcates one of the ground channels; and b) portions of the bifurcated ground channel are coupled to one another via the conductive trace on the substrate.

15. A switching circuit, comprising:

a) a substrate;

b) a channel plate, mated to the substrate to define at least a portion of a number of cavities, comprising:

i) first and second switching fluid channels; and ii) a ground channel located adjacent, and substantially in between, the first and second switching fluid channels;

c) a first switching fluid, held within a cavity defined by the first switching fluid channel, and movable between at least first and second switch states in response to forces that are applied to the first switching fluid; and d) a second switching fluid, held within a cavity defined by the second switching fluid channel, and movable between at least first and second switch states in response to forces that are applied to the second switching fluid.

16. The switching circuit of claim 15, wherein the channel plate further comprises:

a) a second ground channel adjacent the first switching fluid channel, but not in between the first and second switching fluid channels; and b) a third ground channel adjacent the second switching fluid channel, but not in between the first and second switching fluid channels.

17. The switching circuit of claim 16, further comprising a first ground plane running above said channels, and a second ground plane running below said channels.

18. A switch, comprising:

a) a substrate;

b) a channel plate comprising a switching fluid channel, mated to the substrate to define at least a portion of a number of cavities;

c) a pair of ground traces adjacent the switching fluid channel; and d) a switching fluid, held within a cavity defined by the switching fluid channel, and movable between at least first and second switch states in response to forces that are applied to the switching fluid.

19. The switch of claim 18, wherein the pair of ground traces is deposited on the substrate.

20. The switch of claim 18, wherein the pair of ground traces is formed in an interior layer of the substrate.

21. The switch of claim 18, wherein the pair of ground traces is deposited on the channel plate.

22. The switch of claim 18, further comprising a first ground plane running above said channels, and a second ground plane running below said channels.

23. The switch of claim 22, wherein the first and second ground planes are electrically coupled to each other and to the ground traces.

* * * * *